US005318494A

United States Patent [19]

Santighian

[11] Patent Number: 5,318,494

[45] Date of Patent: Jun. 7, 1994

[54] ELASTICALLY RESILIENT EXERCISE DEVICE

[76] Inventor: Krikor Santighian, 2402 Midlothian Dr., Altadena, Calif. 91001

[21] Appl. No.: 661,849

[22] Filed: Feb. 27, 1991

[51] Int. Cl.[5] ..... A63B 21/02

[52] U.S. Cl. ..... 482/125; 482/121

[58] Field of Search ..... 272/143, 142, 136, 137, 272/135, 116, , 139; 482/124, 125

[56] References Cited

U.S. PATENT DOCUMENTS

| | | | |
|---|---|---|---|
| 554,636 | 2/1896 | Hulsman | 482/124 |
| 2,224,103 | 6/1939 | Nilson | 272/137 |
| 3,966,204 | 6/1972 | Duback . | |
| 4,023,808 | 5/1977 | Herbert | 272/137 |
| 4,033,580 | 7/1997 | Paris . | |
| 4,040,620 | 8/1997 | Friedman . | |
| 4,057,246 | 11/1977 | Wilson . | |
| 4,121,827 | 10/1978 | Weider | 272/137 |
| 4,245,840 | 1/1981 | Van Housen . | |
| 4,251,071 | 2/1981 | Norton | 482/125 |
| 4,565,367 | 1/1986 | Kaiser . | |

*Primary Examiner*—Richard J. Apley
*Assistant Examiner*—Jerome Donnelly
*Attorney, Agent, or Firm*—Ladas & Parry

[57] ABSTRACT

An exercising device comprising an elastic cord forming a continuous loop whereon three movable rings are disposed for forming a triangular stretching device defining three adjustable loops. Two lower loops form stirrups to receive and hold each foot of the user in a side-by-side relationship and a loop at the apex can be adjusted to receive and exercise the neck or head, or be gripped by the hands. A variety of muscle-toning exercises for the back, neck, arms, stomach, thighs and legs can be performed, and the loop can take numerous shapes and arrangements adaptable for a wide variety of exercises.

9 Claims, 2 Drawing Sheets

ELASTICALLY RESILIENT EXERCISE DEVICE

BACKGROUND OF THE INVENTION

America is going through a physical fitness renaissance. In the past decade the proliferation of health spas and clubs attests to that fact. Aerobic exercise has become popular, both in class sessions and at home, with the use of video tapes or programs. Most people are content to exercise in their home environment and are reluctant to join clubs or purchase the expensive mechanical exercising devices that are now available.

In order to enhance the beneifts of a physical self-improvement exercise or calisthenics program, the present invention provides a simple, inexpensive, lightweight exercising device that is adaptable to a great variety of exercises for development of chest, back, shoulder, stomach, arm, leg and thigh muscles.

The instant invention embodies a continuous closed loop or circle of elastic material accompanied by three rings capable of ready removal from or attachment to the continuous elastic loop by doubling the loop at any point and selectively inserting that double portion into the three rings to form secondary or smaller loops around the elastic circle to achieve the exercise methods and routines described and illustrated.

No prior art is known to Applicant having the structure herein described nor its mode of application of rings for the exercises described and illustrated herein.

The closest prior art are the patents to Norton, No. 4,251,071 issued Feb. 7, 1981; to Vanhousen, No. 4,245,840 issued Jan. 20, 1981; and to Dubach, No. 3,966,204, issued Jun. 29, 1976. Other patents on prior art known to Applicant are a patent to Nilson, U.S. Pat. No. 224,103, Dec. 3, 1940; Weider, U.S. Pat. No. 4,121,827, Oct. 24, 1978; Wilson, U.S. Pat. No. 4,057,246, Nov. 8, 1977; Kaiser, U.S. Pat. No. 4,565,367, Jan. 21, 1986; Freidman, U.S. Pat. No. 4,040,620, Aug. 9, 1977; Paris, U.S. Pat. No. 4,033,580, Jul. 5, 1977.

None of the foregoing prior art use the combination of the continuous loop of elastic together with the removable ring construction of this application defining the auxiliary loops in any desired location and of any desired size. None of the foregoing or any other art known to Applicant provide the versatility or flexibility of Applicant's construction nor permit the variant exercises accomplished thereby. Some of the exercises are of significant importance and utility and they cannot be achieved by any of the prior art devices, whether singly or collectively.

BRIEF SUMMARY OF THE INVENTION

The primary object of my invention is to provide a simple, easy to carry, inexpensive exercising device that permits a person to exercise a multiple number of body muscles without the use of anchored mechanisms or mechanical devices.

A further object of the present invention is to provide an exercising device that can be easily adjusted for its resistive tension force, thus permitting the user to select the tension that he or she can overcome.

DESCRIPTION OF THE PREFERRED EMBODIMENT

Figure 1:
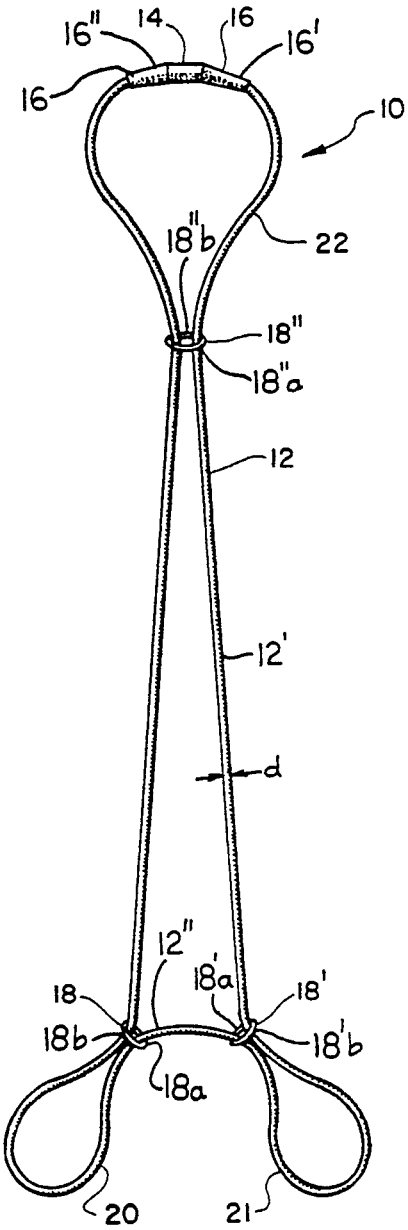
FIG. 1 illustrates the basic exercising device showing the large elastic loop with three rings positioned thereon to form stirrup loops for the feet and an apex loop for the hands, head or neck.

FIG. 1 illustrates a preferred embodiment of Applicant's basic gymnastic exercising device 10 comprising a stretchable and elastic cord formed in a preferably permanent continuous loop 12 having ends permanently joined as at 14, a pair of flexible tubular hand grips 16, and three preferably moveable and slidable plastic, fabric (or the like) or metal rings 18, 18' and 18''.

As shown in FIG. 1, the rights 18' and 18'' can be positioned onto the elastic loop 12 in such an arrangement as to form a triangle. As shown, the continuous loop 12 extends through first ring 18 from a first inside wall 18*a* to a first outside wall 18*b* to define a first stirrup loop 20 adjacent the first outer wall 18*a*. Similarly, the continuous loop 12 extends through second ring 18' from a second inner wall 18'*a* to a second outer wall 18'*b* to define a second stirrup loop 21 adjacent the second outer wall 18'*b*.

The continuous loop 12, as shown for example, in FIG. 1, also has a first portion 12' and a second portion 12'' extending between the first inner wall 18*a* of first ring 18 and second inner wall 18'*a* of second ring 18'.

The first portion 12' extends through the third ring 18'' from the third inner wall 18''*a* to the third outer wall 18''*b* to define an apex loop 22 adjacent the third outer wall 18''*b*.

The flexible tube 16 positioned within the apex loop 22 can serve two purposes: (a) to cover joined ends of the elastic cord to form the loop 12, and (b) to serve as a hand grip means. The inside diameter of the flexible tube 16 is optionally equal to the diameter of the elastic cord comprising the loop 12, thus preferably restricting its unintentional displacement from any desired positions along the cord or arm or any optionally enlarged junction of the ends of the cord.

As shown in the drawing, the tube 16 may be a pair of hand grips 16' and 16''. In preferred embodiments of the present invention the hand grips are movable on the loop 12 so they may be positioned at appropriate locations as required for any particular exercise.

The circumferential length of the loop 12 is advantageously approximately ten feet. This length has been found to form a loop most adaptable to persons of varying heights.

Figure 2:
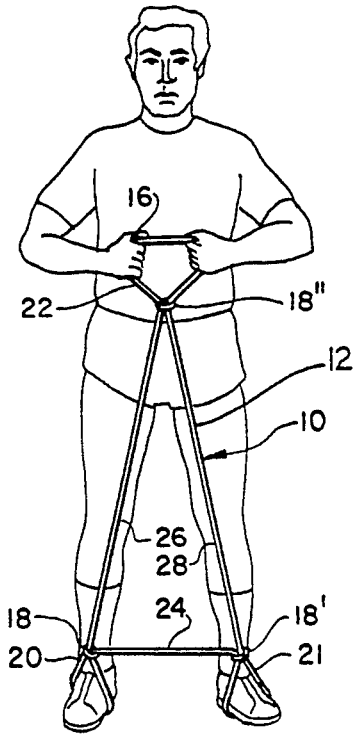
FIG. 2 illustrates the basic position assumed by the exerciser when using the device.
Figure 3:
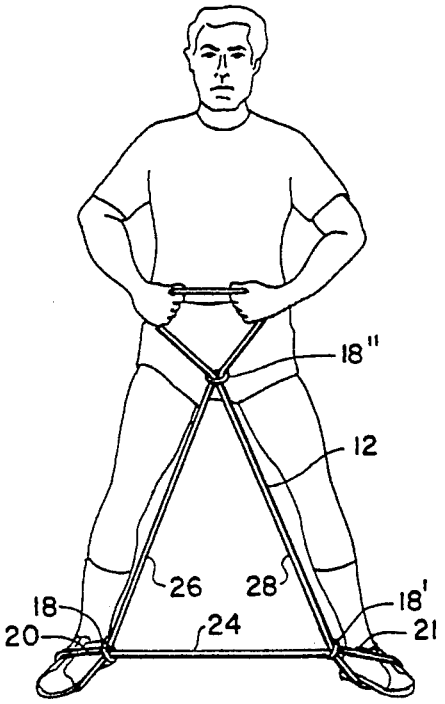
FIG. 3 illustrates the position of the feet of the user to increase the tension in the device.

FIGS. 2 and 3 illustrate a preferred method of adjusting the exercising device 10 for use by persons of short stature and/or for increasing or decreasing its resistive tension. By gripping the handle 16 at the apex loop 22 and inserting the feet in the stirrup loops 20 and 21 and separating the feet in a side-by-side disposition, the resistive tension in the cord sections 24 and 26 is increased. It should also be noted that the height of the apex loop 22 is simultaneously decreased, thereby enabling a person of shorter stature to utilize the device with greater facility and advantage. (See FIG. 3). As clearly depicted in FIG. 3, the exercising device 10 is thereby capable of self-adjusting. As the elastic loop 12 is stretched, the rings 18 forming the stirrup loops 20 and 21, which are preferrably loosely constructed with respect to the diameter "d" at the loop 12 and arranged to slide toward the feet, thus tightening the stirrup loops around the instep of each foot.

FIGS. 2 and 3 also illustrate the position the person can assume to perform the basic exercise for toning the muscles in the arms, chest and legs. The hands gripping the apex loop 22 can be pulled apart aginst the tension of the elastic cord to exercise the arm and chest muscles.

To exercise the thigh and leg muscles, the right foot in the stirrup loop 20 is lifted and lowered against the tension of the cord sections at 24 and 26. The left foot, for example, in the stirrup loop 21 can be lifted and lowered against the tension of the cord sections at 28 and 24 to achieve a similar benefit to the left leg muscles.

Figure 4:
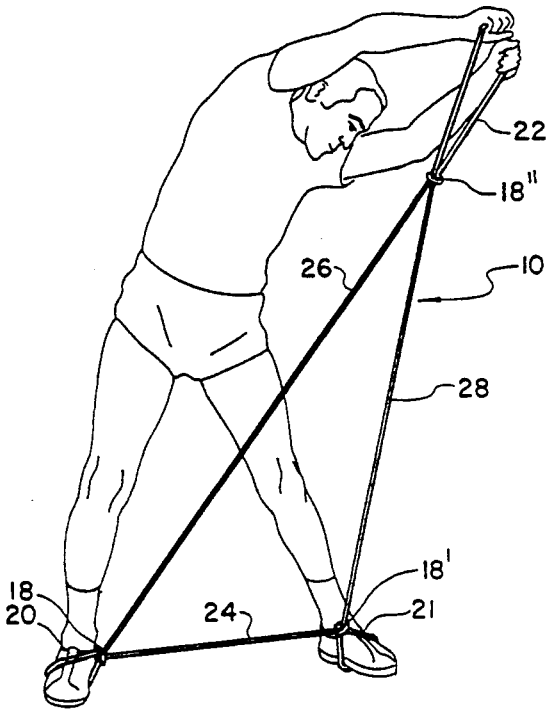
FIG. 4 illustrates one method of exercising the arm, back and shoulder muscles.

In FIG. 4, a simple exercise for the back, arm and shoulder muscles is illustrated. The hands grip the apex loop 22 and are raised upward against the resistive tension in cord sections 26 and 28. In such position, the body may be bent at the torso to stretch the midriff and thus increase the benefits of this exercise.

Figure 5:
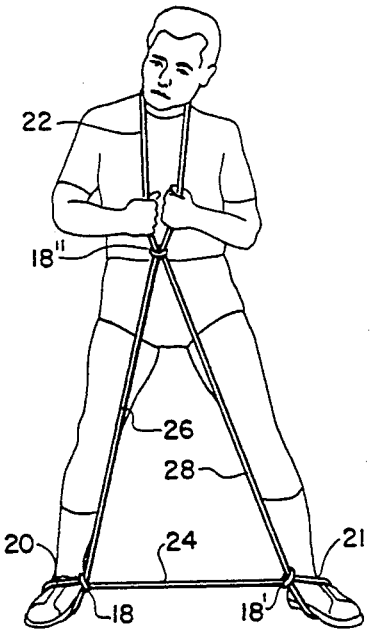
FIG. 5 illustrates the method of exercising using, among others, the neck muscles in a standing position.

FIG. 5 illustrates a method for exercising the neck muscles by inserting the head through the apex loop 22 and then rotating the head forward and backward, and from side to side.

Figure 6:
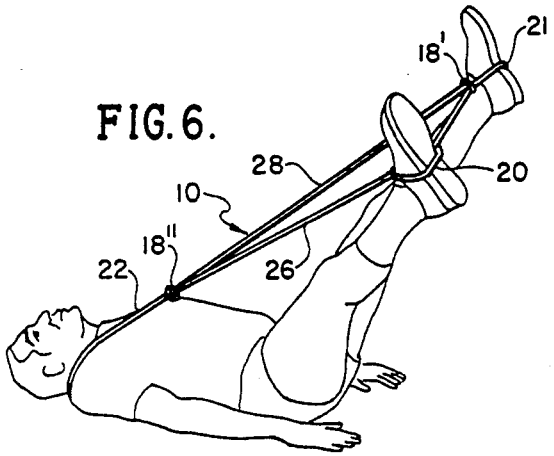
FIG. 6 illustrates the method of exercising the abdominal muscles.

FIG. 6 illustrates a method for exercising the stomach muscles by the user lying on his or her back with the exercising device 10 mounted as shown in FIG. 5. By lifting and lowering the legs, the muscles in the legs and abdominal region are also toned, tensioned and exercised.

Figure 7:
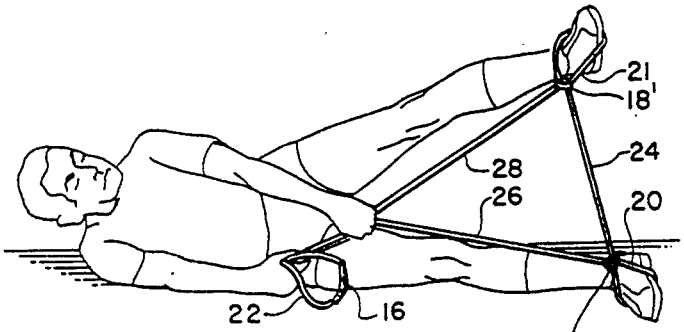
FIG. 7 illustrates the method of exercising the thigh and buttock muscles.

By assuming the position shown in FIG. 7, a left leg-lift exercise can be performed with the device 10. By gripping the cord sections 26 and 28 tightly at a position closer to the foot stirrups 20 and 21, a variable and optionally greater force will be required to stretch the cord section 24. Keeping the leg stiff and raising it against the resistive tension in the cord section 24 will involve and exercise the muscles of the thigh and buttock regions. Such reclining position is reversed (lying on the left side) for exercising the opposite (right) leg.

Figure 8:
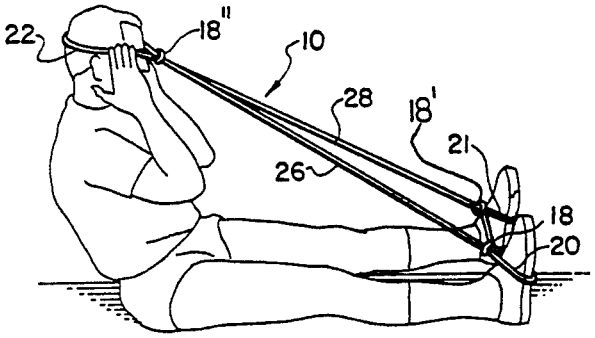
FIG. 8 illustrates the method of exercising using, among others, muscles from a sitting position.

FIG. 8 illustrates the body position assumable with the exercise device 10 fitted on the head of the user and the feet maintained in the stirrups 20 and 21. This exercise will exert pressure on the neck muscles as well as the stomach muscles, as the upper torso is moved forwardly and backwardly.

Although six different body-shaping exercises have been illustrated in this disclosure, many other exercises can be performed with the present invention. By maintaining the feet in the stirrups 20 and 21 and bringing the portion 12' of loop 12 between the legs and across the back of the user, additional exercises can be performed either in the standing position or lying, e.g., on the stomach.

The illustrations in FIGS. 2 through 8 were used to depict the versatility of the exercising device 10 disclosed herein. The variety of muscle-toning exercises, however, is only limited by the imagination and/or energy expended by the person using said device.

The instant fitness device is characterized by its simplicity and wide capability of use by almost everybody. The three rings can snap and fasten the feet and the body of the user in any desired position, and can adjust the length of the stretch cord from five feet in height (10 feet circumference) down to three feet. The enormous versatility and wide utility of the invention can be seen from an examination of the following possible uses:

Basic Positioning

In FIG. 1, with the rings as shown in the drawing, insert the right foot in stirrup loop 20 and the left foot in stirrup loop 21. Then hold the hand grip 16 positioned in apex loop 22 with the hands positioned in the middle of the cord (FIG. 2). Depending on the user's height, he or she can adjust the desired length and stretch by moving the feet apart or bringing them closer together. In this way, the workout can be heavier or lighter, depending upon the user's physical condition. Once the user has established the desired length, he or she can tension-up the stretch cord and the rings 18' and 18'' will be locked in, fastening the feet. In this position, for example, the user can exercise arm curls with one arm or both.

Standing Position

The basic position can be used to strengthen shoulders for golf, tennis or other sports, by stretching over the head, swinging the arms and twisting the body. Also, from this standing position (FIG. 2) the stretch cord may be placed around the neck (FIG. 5), securing the ring 18, exercising the legs, abdomen, waist, hips and neck, side trunk bends, forward and backward bends, side leg raises, back and forward leg swings, knee lifts, and many more.

In a variation of this position, by removing the upper ring 18'', holding the stretch cord at the chest level and positioning the rings 18 and 18' to provide a desired tension, the user can work out the chest muscle, abdomen, shoulders and back. For example: cross body—arms swinging, arms raised over the head, and so forth.

Still another variation of this position is to restore the ring 18 and put the stretch cord between the legs and behind the shoulders. The ring 18 holds the stretch cord in place and prevents it from sliding down from the back of the shoulders. Now the user can exercise the neck, abdomen, back, hips, thighs and shoulders doing lateral body bending, forward bending, body twisting, and so on—almost ad infinitum. With the hands (palms oriented upward) the user can remove the stretch cord from the shoulders and exercise the triceps and shoulders by doing curls behind the head, or by fully extending the arms upwardly. The user can then assume the initial position (FIG. 2) with the stretch cord and ring 18'' at the chest level.

Other Positions

With a little imagination the user can develop more and more exercises from standing or any other position once he or she gets confidence and feels secure with the positioning capability of the three rings 18, 18' and 18''.

By moving from standing to sitting position, the user can position the rings 18 and 18' adjacent the feet, and the apex loop 22 around the head (fastened with the ring 18''), can exercise the neck forward, backward, laterally and in circles. Additionally, the user can remove the stretch cord from the head and put it around the neck, using the ring 18''. The user can also adjust the desired tension and length by opening or closing his or her feet.

Another suggested use of the device is to hold the hands, palms oriented downwardly, with the stretch cord between the feet in stirrup loop 20 and stirrup loop 21 and the apex loop 22 around the neck, the user lying on his or her back. From this position, the user can do sit-ups, the device being capable of sliding and stretching through the rings. This type of sit-up is excellent for the back, abdomen, neck, chest, arms and legs.

Getting back once again to the initial position, people with less strength or more advanced age can use the segments above the feet for rowing. For stronger use, remove ring 18, hold loops 20, 21 and 22 with both hands, position rings 18 and 18', and adjust the desired length by opening or closing the distance between the feet. In this manner, one could exercise rowing, curls, back, biceps, triceps, abdomen, legs and chest.

Coming back to the initial position (FIG. 2) and restored apex loop 22, holding hand grips 16 in the hands or put around the neck (whatever fits more comfortably), position rings 18 and 18', insert feet in stirrup loops 20 and 21 and lie down on the back. Raise the legs fully extended and do lateral swings, separating and bringing together the feet. Turn on one side and exercise the abdomen, thighs and back, raising the upper leg and bringing it up and down, or moving forward and backward parallel with the ground. There are many other such exercises which require just a little imagination.

Another major group of exercises can be performed by lying face down: With the rings 18 and 18' in place, stretch the cord from the back of the body and put apex loop 22 around the back of the shoulders, fastening it with ring 18''. To execute leg curls or full extension of the legs and arms—roll on the stomach with the legs and arms high up. The same exercise may be done by removing the stretch cord from around the back of the shoulders with both hands (palms oriented upward) fully extended forward, and by stretching the cord and increasing the tension. If more tension is needed, stretch the legs apart until the desired tension is obtained. To exercise the legs, back, shoulders, neck and chest, do leg curls, arm curls, rolling on the stomach and swinging the legs.

The invention, as set forth, is usable by older people, by people with limited motion or in rehabilitational programs (joint surgeries or other kinds of surgeries in which water exercises could be replaced by this stretching cord device). Sitting on a chair, the user can exercise more safely than in the water—the back, abdomen, legs, knees, etc. Users are adjusting more easily to this device and the results are much faster, eliminating the fear of water, the time, and all the hassles involved in finding a pool and a therapist.

Additionally, this stretch cord device can be used during lunch breaks, coffee breaks or the like, in any house and in any room of almost any size. The device of this invention can be transported everywhere and can be stored any place and under any conditions.

The device of this invention is preferrably made by a stretch cord having a relaxed diameter of a minimum $\frac{3}{8}$ of an inch, with a stretch expansion between 65% to 100%, and a relaxed circumferential length of ten feet; and could be made adjustable for any person with heights of from 4'8" to 6'3" with the help of three plastic or metal rings. The rings preferrably are rigid and have an inner diameter (for the $\frac{3}{8}$" diameter stretch cord) of one inch to allow sliding movement on the cord 12. The device weighs about $\frac{1}{4}$ of a pound (approximately 120 gr.).

The invention described above is susceptible to many variations, modifications and changes. It should be understood that all such variations, modifications and changes are within the spirit and scope of the invention and the appended claims. Similarly, it will be understood that it is intended to cover all changes, modifications and variations of the examples of the invention herein disclosed for the purpose of illustration which do not constitute departures from the spirit and scope of the invention.

What is claimed is:

1. An exercising device comprising, in combination:

a resiliently stretchable and flexible cord defining a continuous loop means having a predetermined circumferential length, a predetermined stretch expansion and a predetermined relaxed diameter;

a first ring having a first outside wall and a first inside wall and moveably mountable on said loop means, and said loop means extending through said first ring from said first inside wall to said first outside wall thereof to define a first stirrup loop adjacent said first outside wall of said first ring;

a second ring having a second outside wall and a second inside wall and moveably mountable on said loop means and said loop means extending through said second ring from said second inside wall to said second outside wall to define a second stirrup loop adjacent said second outside wall of said second ring, and said second stirrup loop spaced from said first stirrup loop;

said continuous loop means further having a first portion and a second portion extending between said first inside wall of said first ring means and said second inside wall of said second ring means;

a third ring having a third inside wall and a third outside wall moveably mountable on said first portion of said loop means and said first portion of said loop means extending through said third ring from said third inside wall to said third outside wall to define an apex loop adjacent said third outside wall of said third ring, and wherein movement of each of said first ring, said second ring, and said third ring towards and away from each other increases and decreases the size of said first stirrup loop, said second stirrup loop, and said apex loop, respectively.

2. The arrangement defined in claim 1 wherein:

said first portion of said loop means further comprises a first section extending between said third inside wall of said third ring and said first inside wall of said first ring, and a second section extending between said third inside wall of said third ring and said second inside wall of said second ring.

3. The arrangement defined in claim 2 wherein:

said predetermined circumferential length of said loop means is approximately 10 feet.

4. The arrangement defined in claim 3 and further comprising:

handgrip mounted on said loop means.

5. The arrangement defined in claim 4 wherein:

said handgrip is moveably mounted on said loop means.

6. The arrangement defined in claim 5 wherein:

said loop means has a stretch expansion of between 65% and 100%.

7. The arrangement defined in claim 6 wherein:

said loop means has a relaxed diameter not less than $\frac{3}{8}$ths of an inch.

8. The arrangement defined in claim 7 wherein:

the inner diameter of each of said first ring, said second ring, and said third ring, is greater than twice the relaxed diameter of said loop means.

9. The arrangement defined in claim 8 wherein:

said handgrip further comprises a pair of handgrips moveably mounted on said loop means.

* * * * *